United States Patent [19]

Frechette nee Bussieres

[11] 4,029,057

[45] June 14, 1977

[54] BOILER CONSTRUCTION

[76] Inventor: Jeannette Frechette nee Bussieres, 1250 15th Street North, Charny, Canada

[22] Filed: Nov. 25, 1975

[21] Appl. No.: 635,011

[30] Foreign Application Priority Data

Mar. 6, 1975 Canada ..... 221390

[52] U.S. Cl. ..... 122/149

[51] Int. Cl.[2] ..... F22B 7/12

[58] Field of Search ..... 122/149, 136 R, 75, 122/149, 182

[56] References Cited

UNITED STATES PATENTS

| | | | |
|---|---|---|---|
| 2,080,404 | 5/1937 | Hunter et al. | 122/149 |
| 2,554,092 | 5/1951 | De Poray | 122/182 |
| 2,904,015 | 9/1959 | Penning | 122/149 |
| 3,259,108 | 7/1966 | Craig et al. | 122/149 |
| 3,718,122 | 2/1973 | Agrest | 122/149 |

FOREIGN PATENTS OR APPLICATIONS

| | | | |
|---|---|---|---|
| 567,370 | 10/1957 | Italy | 122/149 |

*Primary Examiner*—Kenneth W. Sprague

[57] ABSTRACT

A boiler of the type including an elongated firebox extending in a longitudinal horizontal direction and fire tubes arranged in to and fro horizontal passes through a heated fluid chamber and wherein the sets of fire tubes defining the to and fro passes respectively are distinctively arranged in laterally juxtaposed and spaced-apart relationship to obtain nearly the same speed of the combustion gases in the fire tubes of each set. In particular, the tubes of one set are laterally positioned on opposite sides of the tubes of the other set with the latter arranged within the transverse confine defined by a transversely triangular flue chamber at one end thereof.

3 Claims, 5 Drawing Figures

BOILER CONSTRUCTION

This invention relates to a boiler construction in particular of the type having an elongated firebox extending in a longitudinally horizontal direction and fire tubes arranged in to and fro horizontal passes through a heated fluid chamber.

Boilers of the above type which have been proposed so far are found unsatisfactory due to accumulation of combustion elements in the fire tubes, presumably due to uneven speeds of the combustion gases in the tubes. There has been noted a degrading efficiency in the boilers of this type apparently due to such accumulations in the fire tubes.

It is a general object of the present invention to provide a boiler of the above type which has a relatively more constant efficiency.

It is a more specific object of the present invention to provide a boiler of the above type wherein the combustion gases travel at nearly the same speed through the fire tubes of each set of tubes.

It is a still more specific object of the present invention to provide a boiler construction of the above type wherein the sets of tubes defining the to and fro passes are laterally juxtaposed and spaced apart to obtain nearly the same speed of the combustion gases in the fire tubes of each set.

The above and other objects and advantages of the present invention will be better understood with the following detailed description of a preferred embodiment thereof which is illustrated, by way of example, in the accompanying drawings, wherein.

Figure 1:
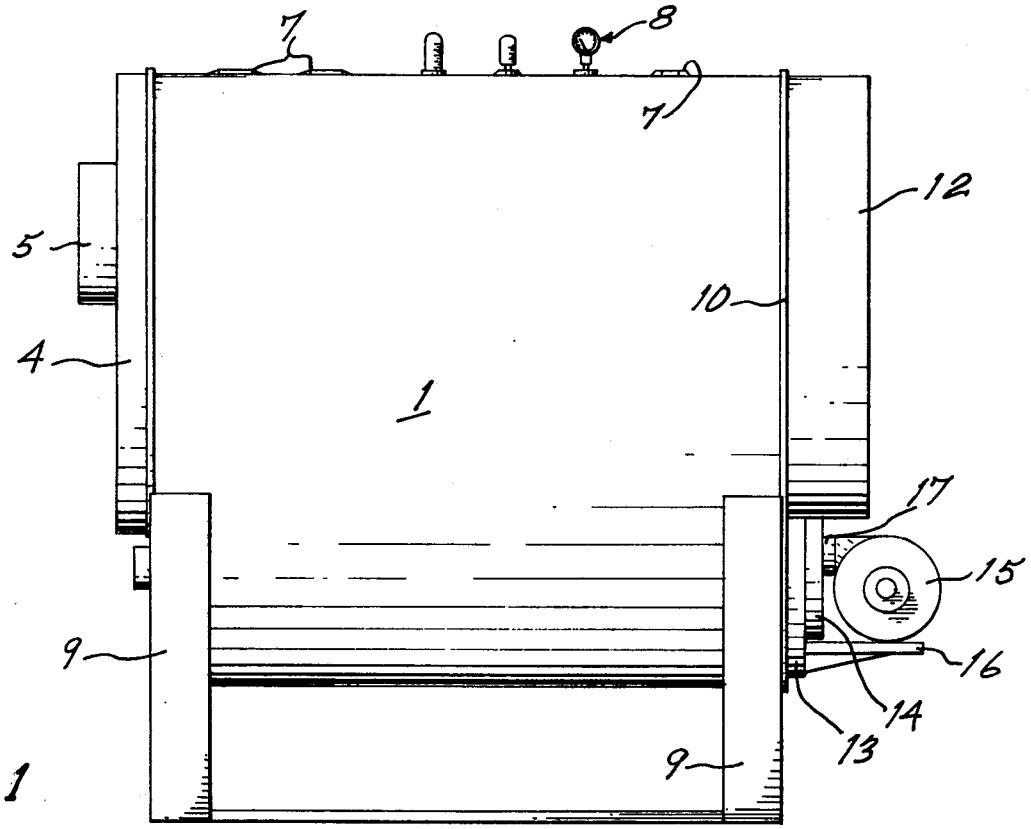
FIG. 1 is a side elevation view of a boiler according to the present invention.
Figure 3:
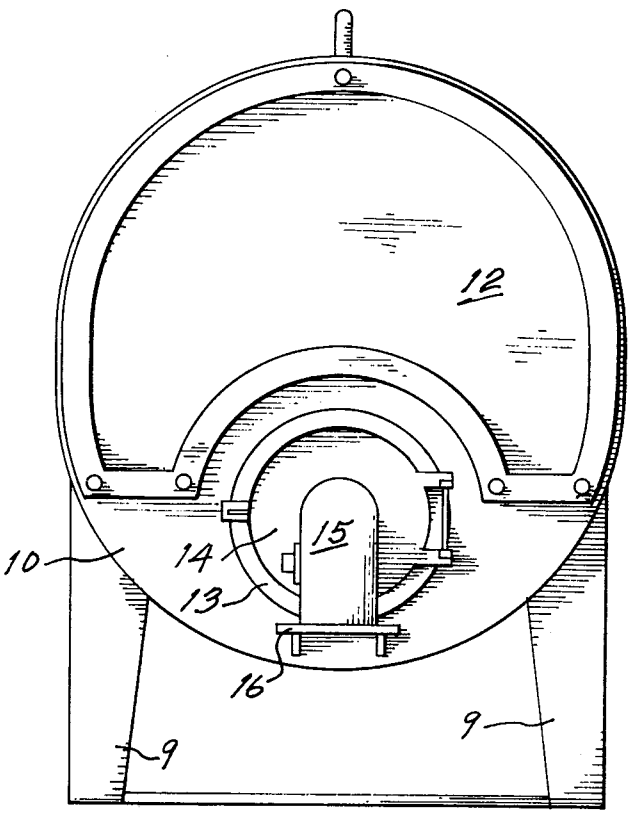
FIG. 3 is a front elevation view of the boiler.
Figure 2:
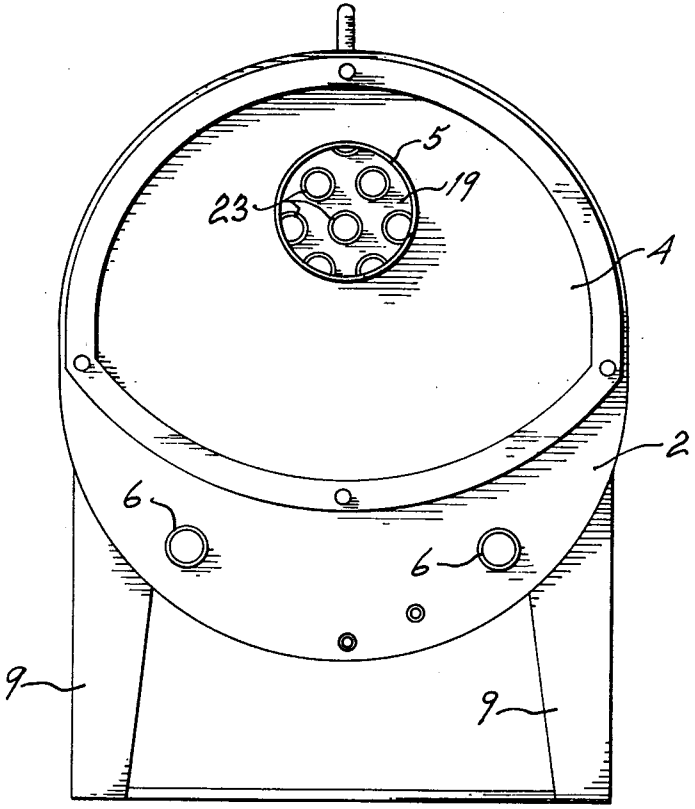
FIG. 2 is an elevation view of the boiler of FIG. 1 as seen from the left in the latter, or in other words, from the rear of the boiler.
Figure 5:
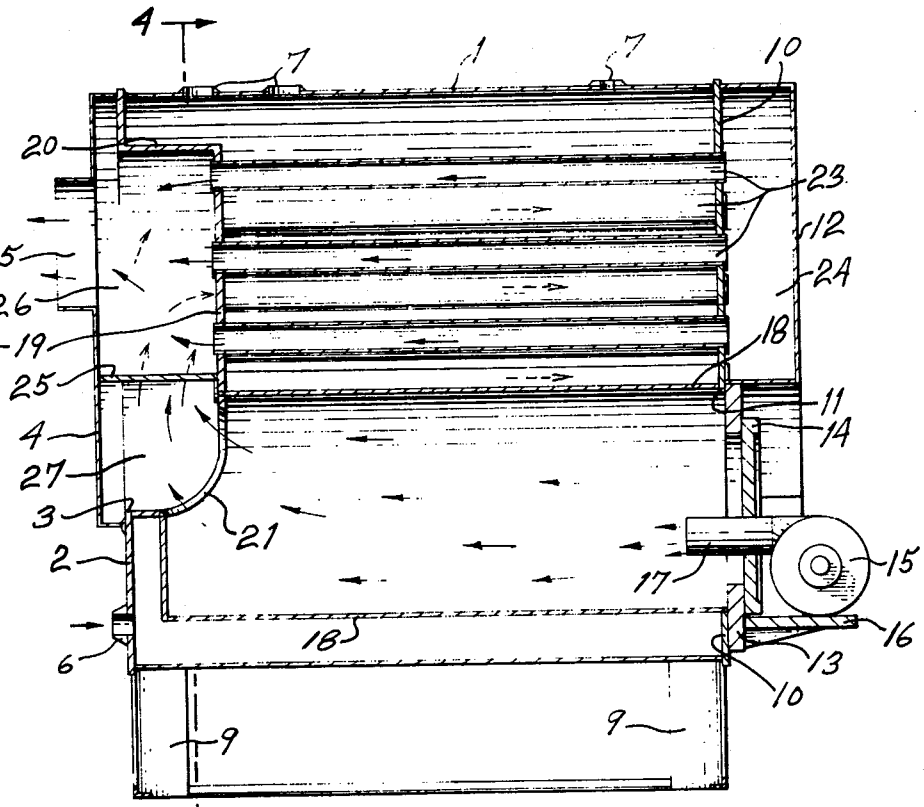
FIG. 5 is a longitudinal cross-section as seen along line 5—5 in FIG. 4.
Figure 4:
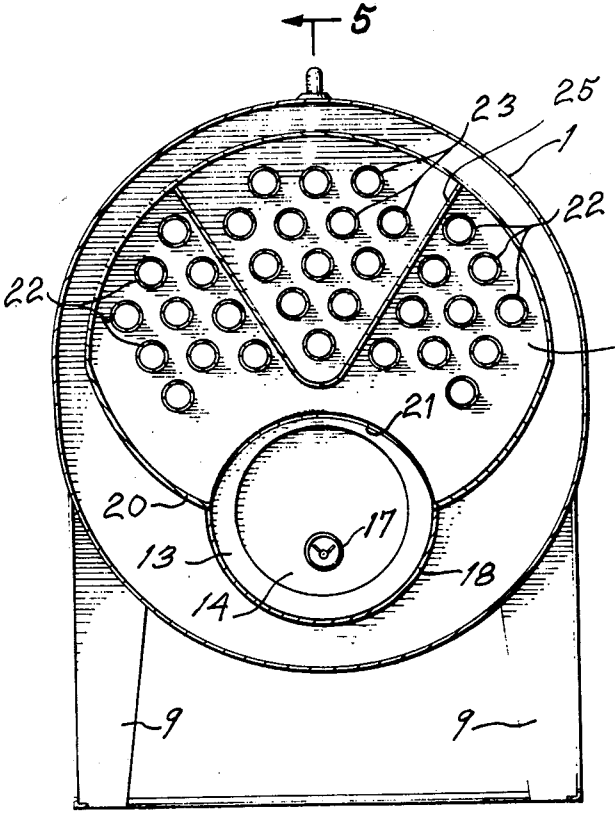
FIG. 4 is atransverse cross-section through the boiler as seen along line 4–4 in FIG. 5.

The illustrated boiler includes a shell 1 of nearly cylindrical shape closed at the rear end by a wall formed with a plate 2 having an aperture 3 in most of the upper portion and a stack connector plate 4. The latter is provided with a stack connecting rim 5 around an opening therein. A pair of fluid inlets 6 are secured to the end plate 2 to supply water in the shell 1. A pair of fluid outlets 7 are secured to the top of the shell 1. The usual gauges 8 are connected to the top of the shell and legs 9 support the whole boiler above the ground. The shell 1 is closed at the front by a transverse wall including an end plate 10 with an aperture 11 through the bottom thereof, a cowl 12, a door frame 13 and door 14 for the aperture 11. An oil burner 15 is mounted on a shelf or bracket 16 secured to the hinged door 14 and has its oil firing nozzle 17 extending into the shell 1.

A cylindrical firebox 18 extends in the shell 1 lengthwise of the longitudinally horizontal direction of the latter and in spaced-apart relationship relative to the lateral wall of the shell.

The end plate 10 forms a transverse partition inwardly spaced relative to the end portion of the cowl 12. Another partition 19 is secured to the end plate 2 and transversely extends in the shell 1 in inwardly spaced relationship relative to the stack connector 4. The transverse partition 19 is formed with a peripheral flange 20 having a cut-out 21 at the bottom thereof communicating with the firebox 18.

A first set of fire tubes 22 and a second set of fire tubes 23 extend between the transverse partitions 10 and 19. The latter is cooperation with the fire tubes 22 and 23 define opposite flue spaces against the internal side of the end walls of the shell 1. All the tubes 22 and 23 communicate with the flue space 24 at the front of the boiler. The other flue space at the rear of the boiler is laterally divided by an upwardly extending partition 25. The latter has a transverse V-shape outline, thus forming a flue chamber 26 of transversely triangular outline and a surrounding flue chamber 27. The triangular flue chamber 26 defines a bottom apex downwardly pointing toward the longitudinal axis of the firebox 18. The upwardly dividing partition 25 ends above the edge of the cut-out 21. Thus, the tubes 23 communicate with the triangular flue chamber 26 and through the latter with the stack, not shown, connecting with the rim 5. The tubes 22 communicate with the flue chamber 27 and through the latter and the cut-out 21 with the firebox 18. Thence, the combustion gases proceed from the firebox 18, through the cut-out 21, into the flue chamber 27, inside the fire tubes 22 forming a first pass, in the flue space 24, inside the fire tubes 23, in the triangular flue chamber 26 and out through the rim 5.

The tubes 22 and 23 are all arranged above the longitudinal axis of the firebox 18 and, preferably, all above the firebox. Besides, the fire tubes 22 and 23 are downwardly spreaded substantially co-extensively in both flue chambers.

Tests made so far have indicated that the aforedescribed boiler construction provides an efficiency of as high as 88%.

What I claim is:

1. A boiler comprising a shell operatively defining a longitudinal direction and including a pair of opposite end wall extending transversely of said longitudinal direction, a pair of partitions extending transversely of said longitudinal direction inwardly of said opposite end walls and confining flue spaces against the inner side of said end walls respectively and an intermediate space between the partitions, an upwardly extending partition dividing one of said flue spaces into a pair of flue chambers laterally juxtaposed transversely of said shell, an elongated firebox longitudinally extending lengthwise of said shell and communicating at one end with one of the laterally juxtaposed flue chambers, a first set of fire tubes connected between said transverse partitions in communication with said one flue chamber and the other of said flue spaces, a second set of fire tubes connected between said transverse partitions in communication with said other flue space and the other of the flue chambers, said transverse partitions cooperatively forming with said tubes a fluid-tight chamber around the latter inside said shell adapted to be filled with a heated fluid medium, said firebox defining a longitudinal axis and said fire tubes being positioned lengthwise of said axis and above the latter, said upwardly dividing partition having a generally V-shaped transverse outline forming a transversely triangular flue chamber constituting said other flue chamber and having an apex downwardly pointing toward the longitudinal axis of the firebox, and the fire tubes of both sets are downwardly spread substantially coextensively in both flue chambers.

2. A boiler as defined in claim 1, wherein the elongated firebox extends through the fluid-tight chamber and is circumferentially surrounded by the latter.

3. A boiler as defined in claim 2, wherein the transverse partition defining said one flue space is formed with a cut-out below said upwardly dividing partition at said apex and in longitudinal registry with the firebox.

* * * * *